United States Patent [19]

Rice

[11] Patent Number: 4,774,641

[45] Date of Patent: Sep. 27, 1988

[54] ILLUMINATED ELECTRIC OUTLET COVER PLATE

[76] Inventor: Keith Q. Rice, 27025 W55thS R1, Viola, Kans. 67149

[21] Appl. No.: 22,404

[22] Filed: Mar. 6, 1987

[51] Int. Cl.[4] ..... F21V 33/00

[52] U.S. Cl. ..... 362/95; 174/66

[58] Field of Search ..... 362/95; 340/815.12, 340/815.18, 815.2; 307/147; 174/66; 200/310, 317, 51.12; 439/489

[56] References Cited

U.S. PATENT DOCUMENTS

| | | | |
|---|---|---|---|
| 2,385,620 | 9/1945 | Fleckenstein | 362/95 X |
| 2,449,150 | 9/1948 | Schnoll | 362/95 X |
| 3,588,489 | 6/1971 | Gaines | 362/95 |
| 3,895,225 | 7/1975 | Prior | 362/95 |
| 4,000,405 | 12/1976 | Horwinski | 362/95 |
| 4,546,419 | 10/1985 | Johnson | 362/95 |

*Primary Examiner*—Ira S. Lazarus
*Assistant Examiner*—Peggy Neils

[57] ABSTRACT

An electric contact means of an illuminating device embodied into electric oulet cover plates. The electric illuminating device is connected electrically to two thin electrical conducting bifurcated blades with spring properties. The open ends of the bifurcated blades are located behind a feed slot and neutral slot in the cover plate that correspond in location to the same slots in the electric outlet. When the cover plate is installed on an electric outlet the closed ends of the two bifurcated blades are automatically inserted into the corresponding feed and neutral slots of the electric outlet making electric contact for the device embodied in the cover plate. The two thin bifurcated blades permit adequate space for normal insertion of electric appliance plugs between the bifurcated blades. Where there is more than one outlet provision, the other outlet provisions are merely corresponding openings in the cover plate that permit appliance plugs to be inserted through the cover plate into the wall outlet. The novel and new bifurcated blade electrical contact design leaves all outlets still available for electric appliance plugs, supplies electric power to the illuminating device embodied in the cover plate with or without an appliance plug installed, and is as easy to install as a standard hardware cover plate using the same attachment means.

1 Claim, 1 Drawing Sheet

ILLUMINATED ELECTRIC OUTLET COVER PLATE

My invention relates to the electrical connection means for illuminating devices embodied into electric outlet cover plates. The objectives of my invention are to provide an electric outlet cover plate with a night light that; leaves all electric outlets still available, has no moving parts except for the spring characteristics of some parts, can be as easily installed as the standard hardware cover plate using the same attachment means, can be installed on any electric outlets or boxes regardless of manufacturer's variations, can be installed on any installation regardless of the position of wires in the outlet box or position of the terminal screws on the electric outlet device, is comparatively inexpensive to manufacture, is commercially desirable, is highly attractive, is "child safe" in regard to electrical shock and burns, is a novel and useful improvement over the prior art.

Heretofore in contrast, there were old patents for illuminated cover plates for electric outlets that claimed easy installation by unskilled persons, but this was not true. They required disconnecting the power to the outlet, removing the outlet from the box, making electrical wire connections to the outlet screw terminals, and placing the outlet and lamp wires back into the box. These difficult installations could easily cause injury to unskilled persons and result in very hazardous installations. Another problem was that some old patents did not have a universal installation design capability and could only be installed on specific matching outlets. Because of the foregoing difficulties, the old patents were not accepted by the public and did not become commercially successful. A recent patent eliminated the preceding disadvantages by making electric contact through electrical conducting fingers that contacted the terminal screw heads of the electric outlets. This worked well when wires in the outlet box and unused terminal screws on the outlets were positioned out of the way. Unfortunately, this is not always the case and then some special installation tools are needed to make a satisfactory installation. My invention eliminates these undesirable aspects of previous patents since it can be installed on all standard outlets as easily as a standard hardware cover plate because it is not affected by any uncontrollable aspects of the electric outlet or outlet box installations.

In order that the invention and its mode of operation may be readily understood by persons skilled in the art, I have in the accompanying drawings and in the detailed following description based thereupon, set out an embodiment of the same.

Figure 5:
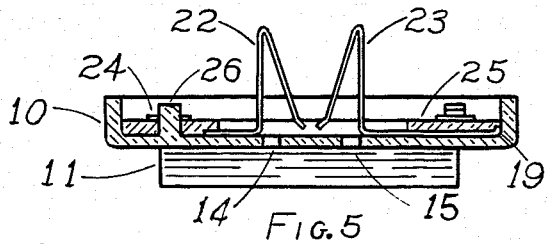
FIG. 5 is a horizontal section through FIG. 3.
Figure 9:
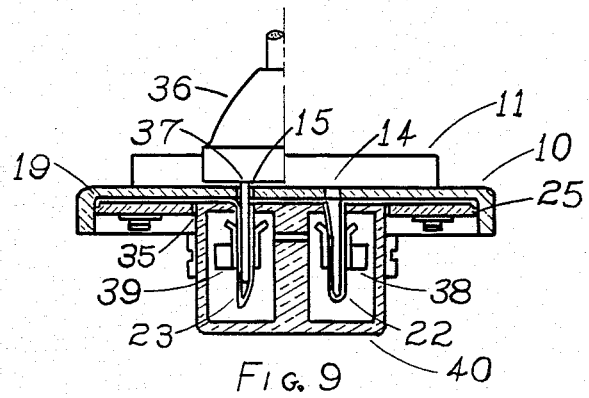

FIG. 9 shows the two bifurcated blades 22 and 23 of FIG. 5 inserted into a corresponding cross section of a typical electric outlet 40 to illustrate the electric contact function of the bifurcated blades with outlet sockets 38 and 39 and ½ of an appliance plug 36 blade 37.

In the drawings I have illustrated a model proven, feasable, and workable design of my invention. The cover plate described herein with illuminating device 11, 27, and 28 installed is to illustrate the function and practicality of using bifurcated blades 22 and 23 as an electrical contact means. These drawings are not intended to limit the invention to the specific design shown, such as, size and shape of the cover plate 10, bifurcated blade 22 and 23 design, bifurcated blade retainment, type of lamp, lamp lens, assembly detail, and assembly fastening means.

The cover plate 10 as shown in FIGS. 1, 2, 3 and 4 on the drawing is molded from a suitable dielectric plastic, having feed slot openings 14 and 17 and neutral slot openings 15 and 18 and ground socket openings 16 and 20 that correspond to the same openings on all standard electric outlets, having openings 12, 13, and 21 for receiving the attachment means of all standard hardware electric outlets, having an opening 41 for lamp lens 11, and having four pegs 26 molded on the back.

Figure 3:
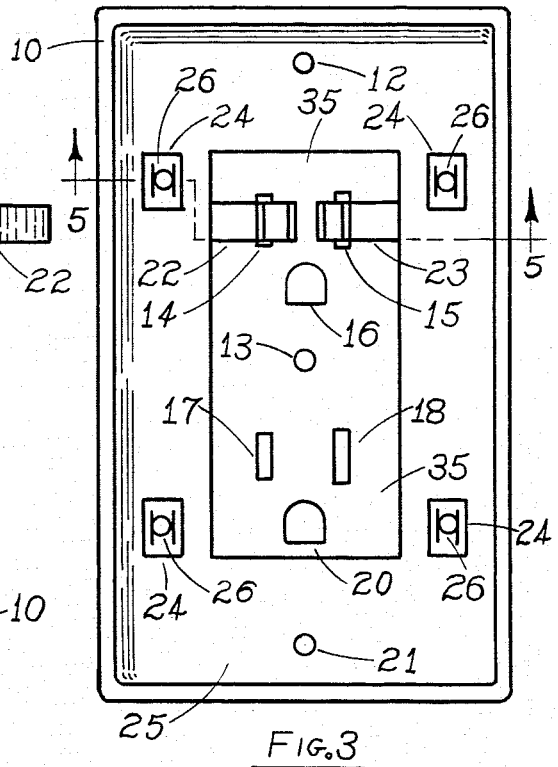
FIG. 3 is a rear elevation of the same.
Figure 4:
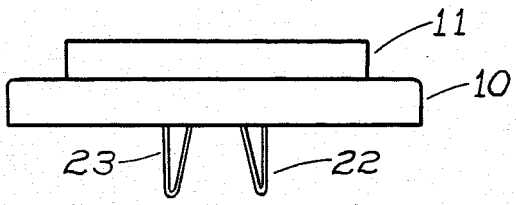
FIG. 4 is a bottom elevation of the same.

FIG. 5 is a cross section through FIG. 3 denoted by cross section line 5 and viewed in the direction of the arrows. It illustrates the position of the open ends of the two similar bifurcated blades 22 and 23 mounted behind feed and neutral slots 14 and 15 respectively and how the blades 22 and 23 are held in place by tabs 19, two upper grooves 34 shown in FIG. 6, and the clamping action between cover plate 10 and interior plate 25. The clamping between cover plate 10 and interior plate 25 is accomplished by pegs 26 on cover plate 10 passing through holes 31 shown in FIG. 6 on interior plate 25 and fastened with standard hardware spring clips 24.

Figure 6:
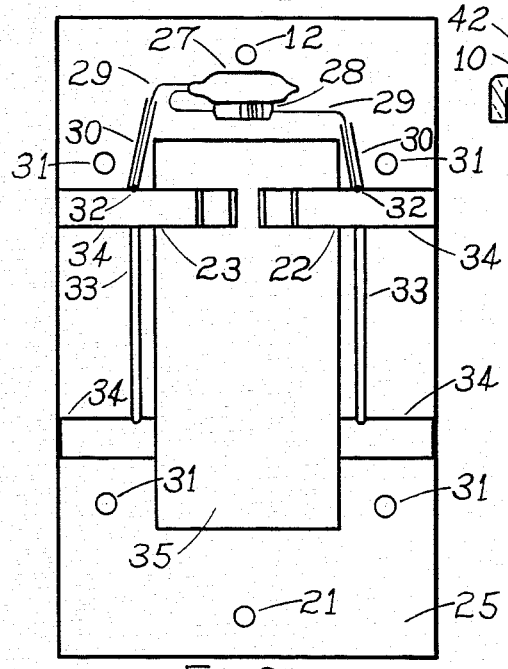
FIG. 6 is a front view of interior plate 25.

FIG. 6 is a view of the opposite side of interior plate 25 as viewed in FIG. 3. Grooves 30 are for wires 29 from the two bifurcated blades 22 and 23 to lamp 27 and resistor 28. Solder joints 32 connect wires 29 electrically to the two bifurcated blades 22 and 23. The upper two grooves 34 locate and position the bifurcated blades 22 and 23. Grooves 33 and lower grooves 34 are used for wire routing and bifurcated blades for split circuit assemblies where slots 17 and 18 are used in lieu of slots 14 and 15. Rectangular hole 35 provides for proper alignment with the electrical outlet 40 in FIG. 9. Holes 31 are for pegs 26 shown in FIG. 3. Holes 12 and 21 are for attachment screws to the electric outlet.

Figure 1:
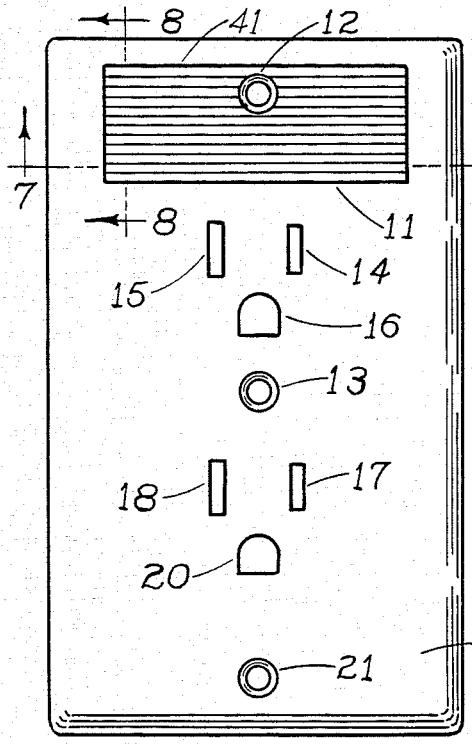
FIG. 1 is a front elevation of my invention.
Figure 2:
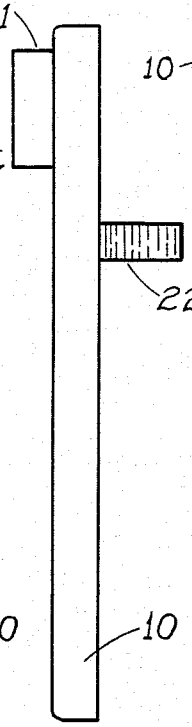
FIG. 2 is a side elevation of the same.
Figure 7:
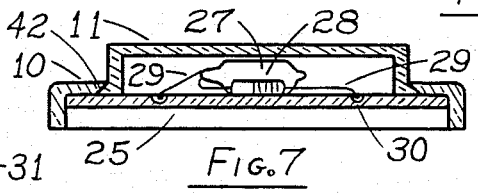
FIG. 7 is a horizontal section through FIG. 1.

FIG. 7 is a cross section through FIG. 1 denoted by cross section line 7 and viewed in the direction of the arrows. This view illustrates how translucent plastic lamp lens 11 is held in place by the tapered edges 42 on lens 11 and hole 41, and the clamping action between cover plate 10 and interior plate 25. Also shown is the position of lamp 27, resistor 28, and wires 29 in grooves 30.

Figure 8:
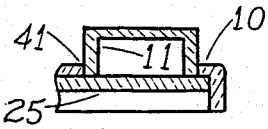
FIG. 8 is a vertical section through a portion of FIG. 1.

FIG. 8 is a cross section through a portion of FIG. 1 denoted by cross section line 8 and viewed in the direction of the arrows. This view enhances the illustration of how lamp lens 11 is installed in cover plate 10 hole 41 and held in by interior plate 25.

FIG. 9 shows the electric contact function of the two similar bifurcated blades 22 and 23 when the cover plate assembly is installed on an electric outlet 40, with and without an electric appliance plug 36 inserted. FIG. 9 is a cross section view of the cover plate assembly, essentially the same as FIG. 5 rotated 180 degrees except for the cross section through peg 26 and spring clip 24, installed on a cross section of a typical outlet provision 40. The right half of this view shows how a bifurcated blade 22 inserted into the electric outlet provision 40 socket 38 makes electric contact for lamp 27 without the blade 37 of an electric appliance plug 36 inserted. Alternately, the left half of this view shows how a bifurcated blade 23 inserted into the electric outlet provision 40 socket 39 makes electric contact for lamp 27 and the appliance with blade 37 of electric appliance plug 36 inserted.

The drawing illustrates a double outlet cover plate 10 and only one outlet provision 14, 15, and 16 has the bifurcated blades 22 and 23. The other outlet provision 17, 18, and 20 consists of openings only through the thin plate that permits appliance plug blades to simply pass through cover plate 10 into the existing wall outlet openings for electric contact for the appliance.

Manifestly, the construction herein shown is capable of considerable modification and such modifications as come within the scope of my claim, I consider within the spirit of my invention.

I claim:

1. An illuminated cover plate for an electric outlet, said outlet having at least one electric outlet provision with a feed slot and a neutral slot and an alternate ground socket to accept electric appliance plugs, comprising a body portion made from a dielectric material having; a depresssion on the back to receive a portion of the electric outlet device to assure blade slot and ground socket alignment, blade slot and ground socket openings through the cover plate that correspond to those said openings in the electric outlet device, two similar electrical conducting bifurcated blades, one of the said electrical conducting bifurcated blades mounted with the open end aligned behind a feed slot, one of the said electrical conducting bifurcated blades mounted with the open end aligned behind a neutral slot, said bifurcated blades dimensioned and designed so that the closed end may be inserted full depth into the electric outlet slots, said bifurcated blades dimensioned and designed to accept the full length insertion of electric appliance plug blades between the bifurcated blades when inserted into the electric outlet slots, said bifurcated blades having sufficient spring properties and appropriate dimensions and design to make electrical contact with the outlet when inserted into the outlet device with or without an electric appliance plug installed, an illuminating device embodied into the cover plate that is connected by an appropriate electric circuit to each of the bifurcated blades, and holes that correspond to the attachment holes in the electric outlet device for fastening the cover plate to the outlet with the same attachment means used for the standard cover plates.

* * * * *